US011488761B2

(12) United States Patent
Shiga et al.

(10) Patent No.: US 11,488,761 B2
(45) Date of Patent: Nov. 1, 2022

(54) LAMINATED ELECTRONIC COMPONENT

(71) Applicant: TDK CORPORATION, Tokyo (JP)

(72) Inventors: Yuto Shiga, Tokyo (JP); Hajime Kato, Tokyo (JP); Kazuya Tobita, Tokyo (JP); Youichi Kazuta, Tokyo (JP); Yuya Ishima, Tokyo (JP); Satoru Okamoto, Tokyo (JP); Shunji Aoki, Tokyo (JP)

(73) Assignee: TDK CORPORATION, Tokyo (JP)

( * ) Notice: Subject to any disclaimer, the term of this patent is extended or adjusted under 35 U.S.C. 154(b) by 265 days.

(21) Appl. No.: 16/021,983

(22) Filed: Jun. 28, 2018

(65) Prior Publication Data

US 2019/0006084 A1 Jan. 3, 2019

(30) Foreign Application Priority Data

Jun. 30, 2017 (JP) ..... JP2017-129411

(51) Int. Cl.

| | |
|---|---|
| ***H01F 27/28*** | (2006.01) |
| ***H01F 27/29*** | (2006.01) |
| ***H01F 5/04*** | (2006.01) |
| ***H01F 5/00*** | (2006.01) |

(52) U.S. Cl.

CPC ..... *H01F 27/2804* (2013.01); *H01F 5/003* (2013.01); *H01F 5/04* (2013.01); *H01F 27/29* (2013.01)

(58) Field of Classification Search

CPC ..... H01F 27/2804; H01F 27/29; H01F 2027/2809; H01F 27/292; H01F 5/003; H01F 5/04

USPC ..... 336/200, 232

See application file for complete search history.

(56) References Cited

U.S. PATENT DOCUMENTS

| | | | | |
|---|---|---|---|---|
| 8,174,349 | B2 * | 5/2012 | Yoshida | H01F 27/292 257/700 |
| 2010/0088316 | A1 | 4/2010 | Robinson et al. | |
| 2013/0015937 | A1 | 1/2013 | Seko | |
| 2013/0088316 | A1 * | 4/2013 | Odahara | H01F 27/292 336/200 |
| 2014/0375412 | A1 | 12/2014 | Seko | |
| 2016/0099100 | A1 * | 4/2016 | Park | H01F 17/0013 336/200 |

FOREIGN PATENT DOCUMENTS

| | | | |
|---|---|---|---|
| CN | 102881402 | A | 1/2013 |
| CN | 102939634 | A | 2/2013 |

(Continued)

*Primary Examiner* — Tszfung J Chan

(74) *Attorney, Agent, or Firm* — Oliff PLC

(57) ABSTRACT

A laminated electronic component includes an element body and a conductor. The element body is formed by laminating a plurality of element-body layers. The element body has a first face, a second face, and a pair of third faces. The conductor is disposed on the element body and has an L shape. The conductor has an exposed face exposed on the first face and the second face. The exposed face includes a plurality of divided regions divided by the element body. The length of each divided region in a dividing direction is longer than a distance with which the plurality of divided regions is separated from each other and longer than a distance with which the exposed face and the pair of third faces are separated from each other.

6 Claims, 13 Drawing Sheets

(56) References Cited

FOREIGN PATENT DOCUMENTS

| | | | | | |
|---|---|---|---|---|---|
| JP | 2002-367833 | A | | 12/2002 | |
| JP | 2006286886 | A | * | 10/2006 | |
| JP | 2008112896 | A | * | 5/2008 | ..... H01G 4/005 |

* cited by examiner

LAMINATED ELECTRONIC COMPONENT

TECHNICAL FIELD

One aspect of the present invention relates to a laminated electronic component.

BACKGROUND

Japanese Unexamined Patent Publication No. 2002-367833 discloses a laminated electronic component including an element body and a terminal electrode pattern. The element body is formed by laminating a plurality of element-body layers. The terminal electrode pattern is formed in such a way as to be exposed on end faces of the element body. According to the structure of this laminated electronic component, by laminating the terminal electrode pattern together with the element-body layers, it is possible to form an external electrode without using a dipping method.

SUMMARY

In the above laminated electronic component, cracks sometimes occur on the surface of the element body.

One aspect of the present invention is to provide a laminated electronic component in which occurrence of cracks on a surface of an element body is suppressed.

According to the investigation and research by the inventors of the present invention, cracks are easily caused on the surface of the element body by heat treatment in manufacturing the laminated electronic component because the thermal shrinkage percentage of the constituent material of the conductor is larger than the thermal shrinkage percentage of the constituent material of the element body. If the volume of the conductor is reduced, the amount of shrinkage of the constituent material of the conductor is to be lowered. However, as the volume of the conductor decreases, the mounting strength can decrease.

Thus, a laminated electronic component according to one aspect of the present invention includes an element body and a conductor. The element body has a rectangular parallelepiped shape and is formed by laminating a plurality of element-body layers. The element body has a first face, a second face, and a pair of third faces. The second face is adjacent to the first face. The pair of third faces is opposed to each other and is adjacent to the first face and the second face. The conductor is disposed on the element body and has an L shape. The conductor has an exposed face exposed on the first face and the second face. The exposed face includes a plurality of divided regions divided by the element body. The length of each divided region in a dividing direction is longer than a distance with which the plurality of divided regions is separated from each other and longer than a distance with which the exposed face and the pair of third faces are separated from each other.

In this laminated electronic component, the exposed face of the conductor is divided by the element body. Thus, it is possible to relax the stress caused by the difference between the thermal shrinkage percentage of the constituent material of the conductor and the thermal shrinkage percentage of the constituent material of the element body particularly on the surface of the element body. Accordingly, it is possible to suppress occurrence of cracks on the surface of the element body. In addition, in this laminated electronic component, the length of each divided region in the dividing direction is longer than the distance with which the plurality of divided regions is separated from each other and longer than the distance with which the exposed face and the third face are separated from each other. Accordingly, the area of the exposed face is easily kept wide. As a result, it is possible to suppress reduction in the mounting strength.

The exposed face may have a first exposed face exposed on the first face and a second exposed face exposed on the second face. The first exposed face and the second exposed face may each include the plurality of divided regions. In this case, it is possible to suppress occurrence of cracks on both the first face and the second face.

The exposed face may be completely divided. In this case, it is possible further to suppress occurrence of cracks.

The exposed face may be divided in an opposing direction of the pair of third faces. In this case, the amount of shrinkage per divided region in the opposing direction of the pair of third faces is smaller than the amount of shrinkage of an entire undivided exposed face. Accordingly, it is possible further to suppress occurrence of cracks extending from the exposed face toward the third face.

DETAILED DESCRIPTION

Hereinafter, embodiments will be described in detail with reference to the accompanying drawings. In the following description, the same reference sign is assigned to the same element or the element having the same function, and the redundant description will be omitted.

First Embodiment

Figure 1:
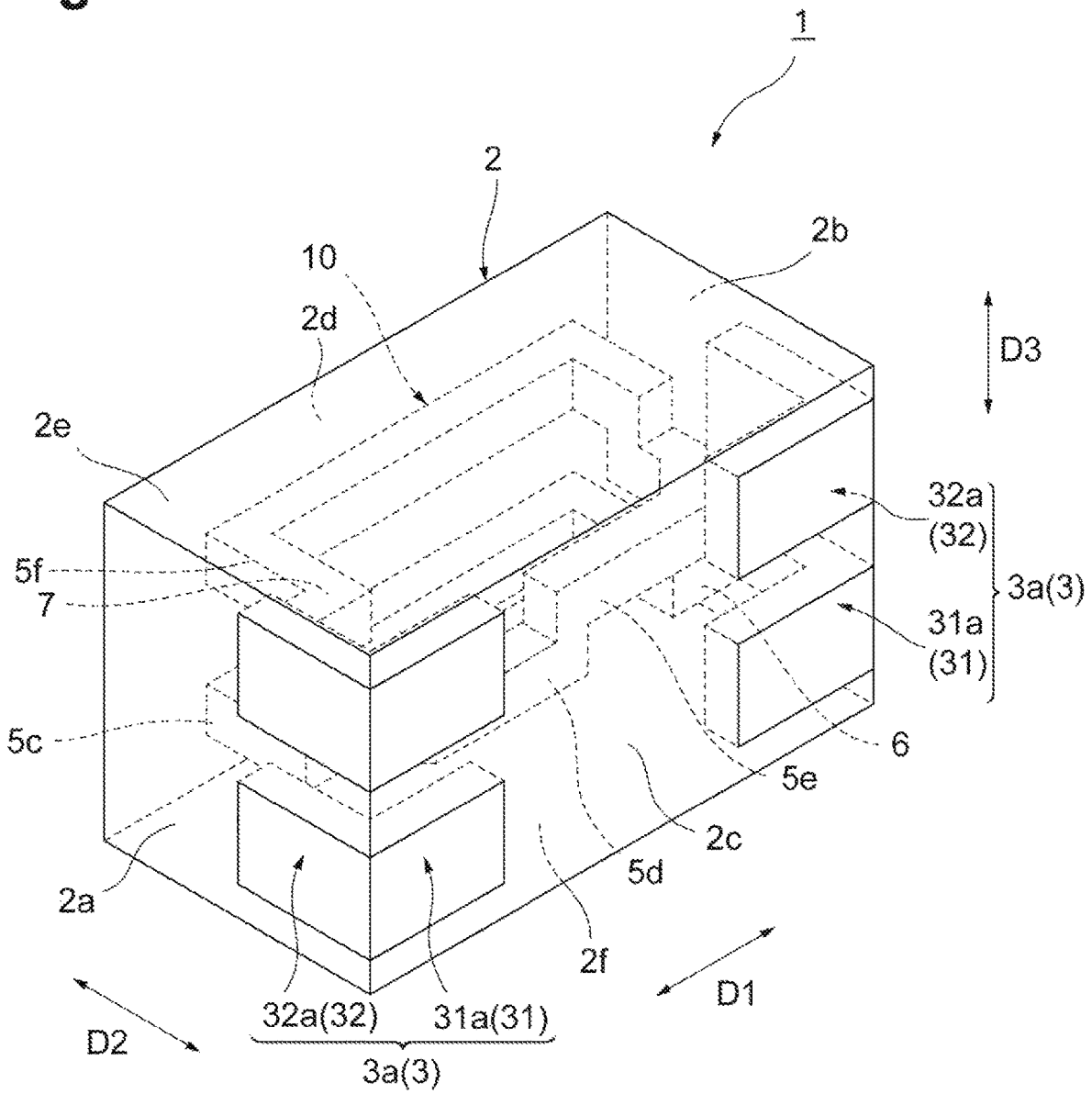
FIG. 1 is a perspective view of a laminated coil component according to a first embodiment.
Figure 2:
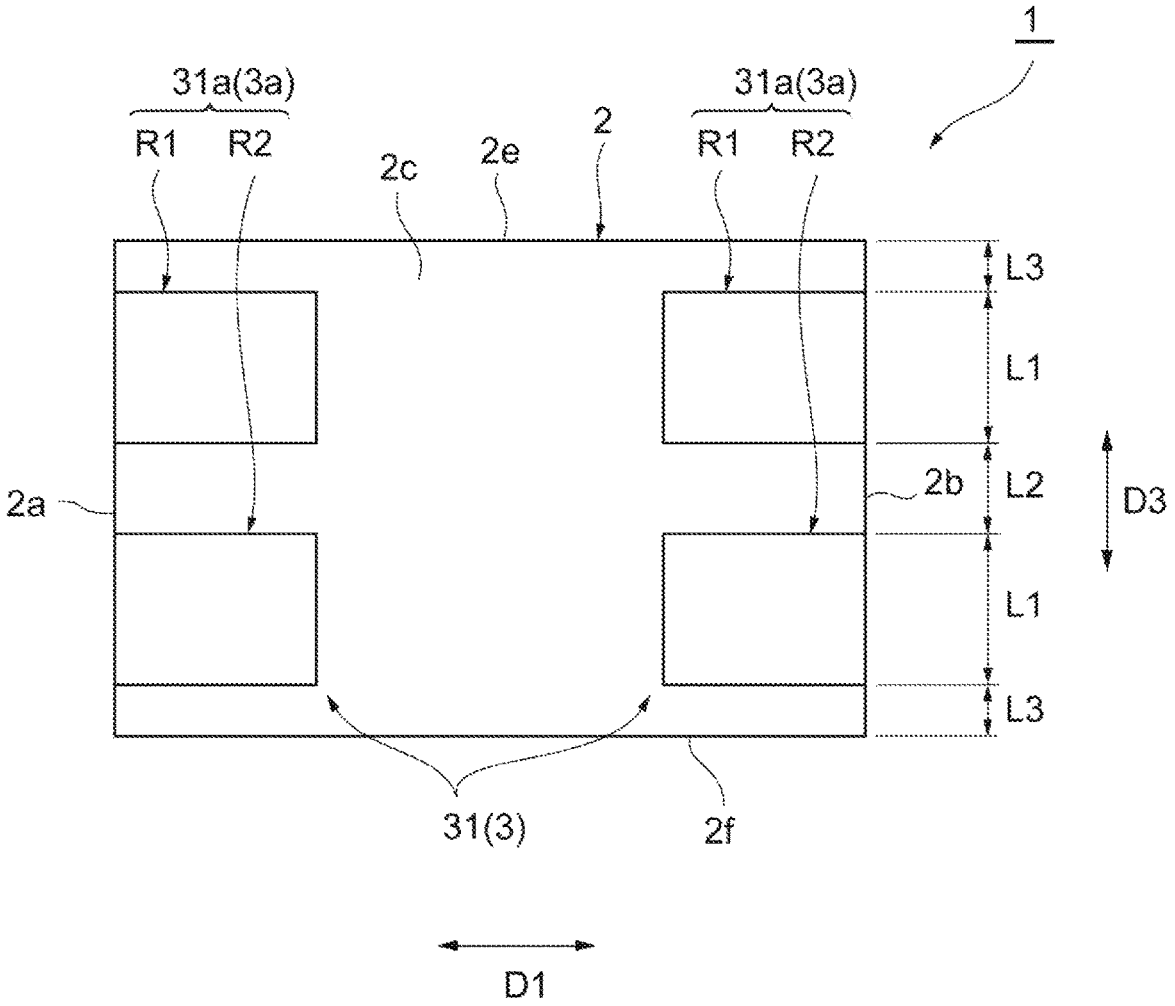
FIG. 2 is a plan view of the laminated coil component in FIG. 1 when viewed from a mounting surface side.
Figure 3:
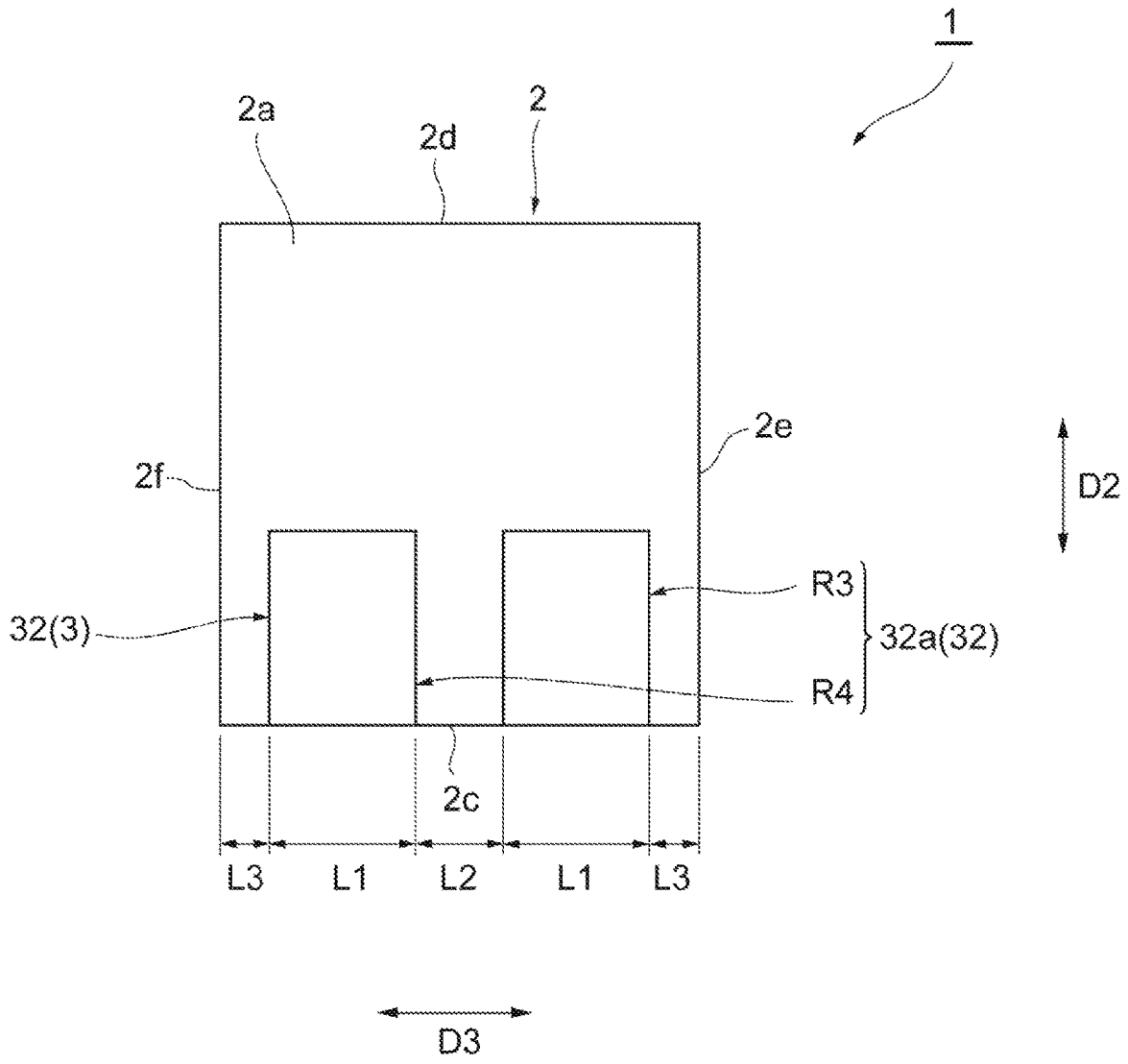
FIG. 3 is a plan view of the laminated coil component in FIG. 1 when viewed from an end face side.
Figure 4:
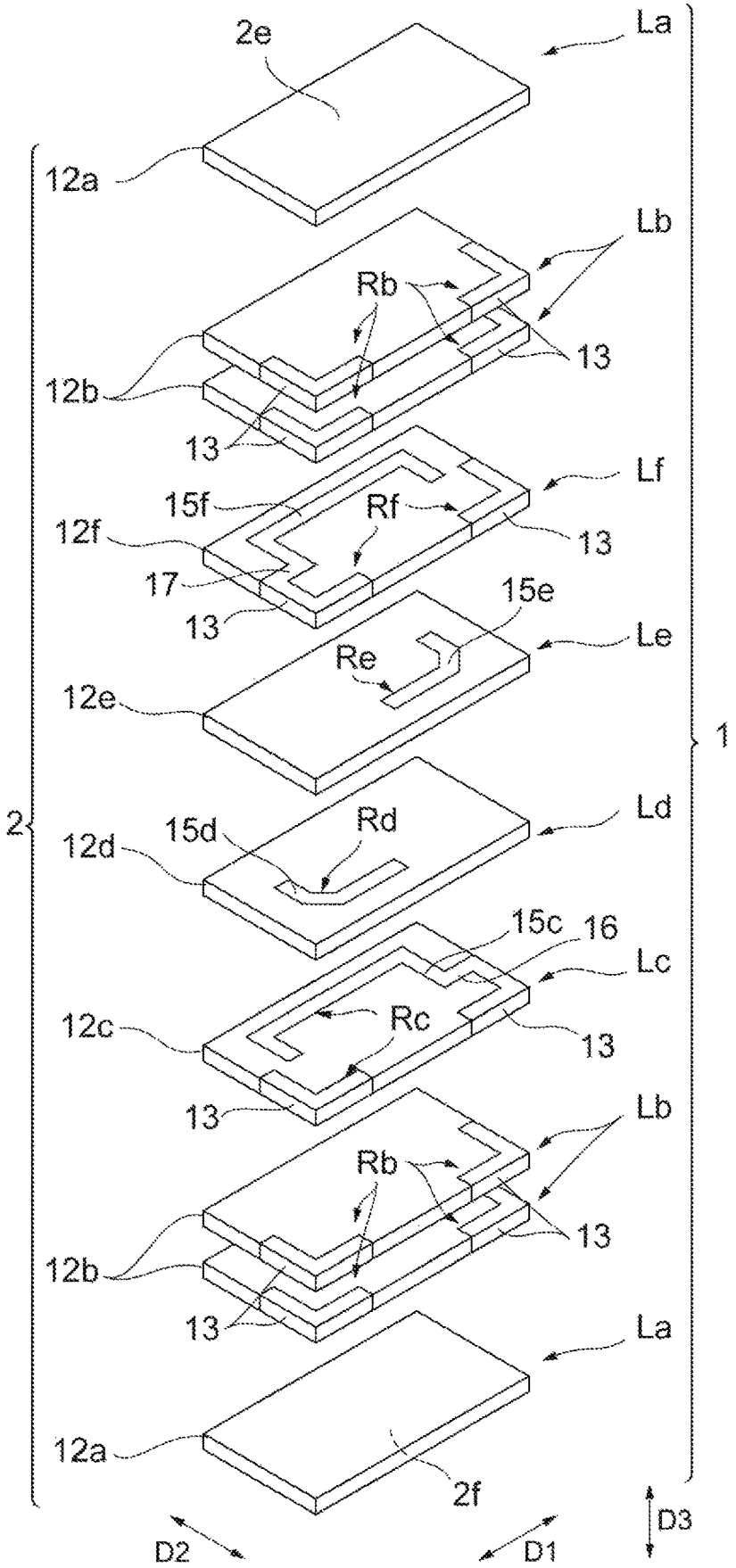
FIG. 4 is an exploded perspective view of the laminated coil component in FIG. 1.

With reference to FIGS. 1 to 4, a laminated coil component according to a first embodiment is described. FIG. 1 is a perspective view of the laminated coil component according to the first embodiment. FIG. 2 is a plan view of the laminated coil component in FIG. 1 when viewed from a mounting surface side. FIG. 3 is a plan view of the laminated coil component in FIG. 1 when viewed from an end face side. FIG. 4 is an exploded perspective view of the laminated coil component in FIG. 1. With reference to FIGS. 1 to 4, a laminated coil component 1 according to the first embodiment includes an element body 2, a pair of conductors 3, a plurality of coil conductors 5*c*, 5*d*, 5*e*, and 5*f*, and connecting conductors 6 and 7.

The element body 2 has a rectangular parallelepiped shape. The rectangular parallelepiped shape includes a rectangular parallelepiped shape in which the corner portions and the ridge portions are chamfered, and a rectangular parallelepiped shape in which the corner portions and the ridge portions are rounded. The element body 2 has end faces 2*a* and 2*b*, and side faces 2*c*, 2*d*, 2*e*, and 2*f*. The end faces 2*a* and 2*b* are opposed to each other. The side faces 2*c* and 2*d* are opposed to each other. The side faces 2*e* and 2*f* are opposed to each other. In the following description, it is assumed that the opposing direction of the end faces 2*a* and 2*b* is a direction D1, that the opposing direction of the side faces 2*c* and 2*d* is a direction D2, and that the opposing direction of the side faces 2*e* and 2*f* is a direction D3. The direction D1, the direction D2, and the direction D3 are substantially orthogonal to each other.

The end faces 2*a* and 2*b* extend in the direction D2 in such a way as to connect the side faces 2*c* and 2*d*. The end faces 2*a* and 2*b* also extend in the direction D3 in such a way as to connect the side faces 2*e* and 2*f*. The side faces 2*c* and 2*d* extend in the direction D1 in such a way as to connect the end faces 2*a* and 2*b*. The side faces 2*c* and 2*d* also extend in the direction D3 in such a way as to connect the side faces 2*e* and 2*f*. The side faces 2*e* and 2*f* extend in the direction D2 in such a way as to connect the side faces 2*c* and 2*d*. The side faces 2*e* and 2*f* also extend in the direction D1 in such a way as to connect the end faces 2*a* and 2*b*.

The side face 2*c* is a mounting surface and is opposed to another electronic device, which is not shown, (for example, a circuit substrate or a laminated electronic component) when, for example, the laminated coil component 1 is mounted on the electronic device. The end faces 2*a* and 2*b* are faces adjacent to the mounting surface (that is, the side face 2*c*).

The length of the element body 2 in the direction D1 is longer than the length of the element body 2 in the direction D2 and the length of the element body 2 in the direction D3. The length of the element body 2 in the direction D2 and the length of the element body 2 in the direction D3 are equivalent to other. That is, in the present embodiment, the end faces 2*a* and 2*b* each have a square shape, and the side faces 2*c*, 2*d*, 2*e*, and 2*f* each have a rectangular shape. The length of the element body 2 in the direction D1 may be equivalent to the length of the element body 2 in the direction D2 and to the length of the element body 2 in the direction D3, or may be shorter than these lengths. The length of the element body 2 in the direction D2 and the length of the element body 2 in the direction D3 may be different from each other.

In the present embodiment, the term "equivalent" may include, in addition to being equal, a value including a slight difference or a manufacturing error in a preset range. For example, if a plurality of values is included within the range of ±5% of the average value of the values, the values are defined to be equivalent.

The element body 2 is constituted by laminating a plurality of element-body layers 12*a* to 12*f* in the direction D3. That is, the lamination direction of the element body 2 is the direction D3. A specific laminated structure will be described later. In the actual element body 2, the element-body layers 12*a* to 12*f* are integrated in such a way that no boundaries between the layers cannot be visually recognized. The element-body layers 12*a* to 12*f* includes, for example, a magnetic material (Ni—Cu—Zn-based ferrite material, Ni—Cu—Zn—Mg-based ferrite material, Ni—Cu-based ferrite material, or the like). The magnetic material forming the element-body layers 12*a* to 12*f* may contain Fe alloy or the like. The element-body layers 12*a* to 12*f* may include a non-magnetic material (a glass ceramic material, a dielectric material, or the like).

The pair of conductors 3 is disposed on the element body 2. Specifically, the pair of conductors 3 is disposed in depressions provided on the outer surface of the element body 2, and is exposed on the outer surface of the element body 2. The pair of conductors 3 is separated from each other in the direction D3. When viewed from the direction D3, each conductor 3 has an L shape. Each conductor 3 has a conductor portion 31 and a conductor portion 32 which are integrally provided. When viewed from the direction D3, the conductor portion 31 extends in the direction D1 and the conductor portion 32 extends in the direction D2. The conductor portion 31 is disposed in a depression provided on the side face 2*c*. The conductor portion 32 is disposed in a depression provided on each of the end faces 2*a* and 2*b*. The conductor portions 31 and 32 each have a substantially rectangular plate shape. The pair of conductors 3 has the same shape. The L shape may be any shape as long as it is a substantially L shape as a whole. For example, the L shape may have depressions and projections provided on the surface of each conductor 3 as long as it is a substantially L shape as a whole. Each conductor 3 is only required to have a substantially L shape as a whole in a case in which the conductor is provided continuously or intermittently.

The pair of conductors 3 has a pair of exposed faces 3*a* exposed on the side face 2*c* and the end faces 2*a* and 2*b*. Specifically, one conductor 3 has one exposed face 3*a* exposed on the side face 2*c* and the end face 2*a*. Another conductor 3 has another exposed face 3*a* exposed on the side face 2*c* and the end face 2*b*. The one exposed face 3*a* includes an exposed face 31*a* exposed on the side face 2*c* and an exposed face 32*a* exposed on the end face 2*a*. The other exposed face 3*a* includes an exposed face 31*a* exposed on the side face 2*c* and an exposed face 32*a* exposed on the end face 2*b*. Here, the exposed face 31*a* is a face of the conductor portion 31. The exposed face 32*a* is a face of the conductor portion 32. The exposed faces 31*a* and 32*a* have the same shape.

The exposed face 31*a* may be positioned in the same plane as the side face 2*c*. The exposed face 31*a* may be positioned at an inner side or an outer side of the element body 2 as compared with the side face 2*c*. The exposed face 32*a* may be positioned in the same plane as the end face 2*a* or 2*b*. The exposed face 31*a* may be positioned at an inner inside or an outer side of the element body 2 with respect to the end face 2*a* or 2*b*. The exposed faces 31*a* and 32*a* are disposed at equal distances from the side faces 2*e* and 2*f*.

The exposed face 3*a* includes a plurality of divided regions R1 to R4 divided by the element body 2. Specifically, the exposed face 31*a* includes the divided regions R1 and R2 divided by the element body 2. The exposed face 32*a* includes the divided regions R3 and R4 divided by the element body 2. The divided regions R1 to R4 have the same shape. The divided regions R1 to R4 each have a rectangular shape.

The divided regions R1 and R2 are divided in the direction D3 and separated from each other in the direction D3.

The dividing direction of the divided regions R1 and R2 and the separating direction of the divided regions R1 and R2 are the same as the lamination direction of the element-body layers 12*a* to 12*f* which is the direction D3. That is, it can be said that the exposed face 31*a* is divided in the lamination direction of the element-body layers 12*a* to 12*f*. The divided regions R1 and R2 are not connected to each other, and the exposed face 31*a* is completely divided.

The divided regions R3 and R4 are divided in the direction D3 and separated from each other in the direction D3. The dividing direction of the divided regions R3 and R4 and the separating direction of the divided regions R3 and R4 are the same as the lamination direction of the element-body layers 12*a* to 12*f* which is the direction D3. That is, it can be said that the exposed face 32*a* is divided in the lamination direction of the element-body layers 12*a* to 12*f*. The divided regions R3 and R4 are not connected to each other, and the exposed face 32*a* is completely divided.

The divided regions R1 and R3 are disposed by the side of the side face 2*e* (closer to the side face 2*e* than the side face 2*f*) and are connected to each other. The divided regions R1 and R3 are connected to each other at a ridge portion of the element body 2 (hereinafter, also referred to as a ridge portion of the side face 2*c*) at which the side face 2*c* and the end face 2*a* or 2*b* are connected to each other. The divided regions R2 and R4 are disposed by the side of the side face 2*f* (closer to the side face 2*f* than the side face 2*e*) and are connected to each other. The divided regions R2 and R4 are connected to each other at the ridge portion of the side face 2*c*. That is, the exposed faces 31*a* and 32*a* are connected to each other at the ridge portion of the side face 2*c*.

The length L1 of each of the divided regions R1 and R2 in the direction D3 is longer than the distance L2 with which the divided regions R1 and R2 are separated from each other and longer than the distance L3 with which the exposed face 31*a* and the side face 2*e* or 2*f* are separated from each other. The length L1 of each of the divided regions R3 and R4 in the direction D3 is longer than the distance L2 with which the divided regions R3 and R4 are separated from each other and longer than the distance L3 with which the exposed face 32*a* and the side face 2*e* or 2*f* are separated from each other.

In each conductor 3, at least the exposed face 3*a* is only required to be divided by the element body 2, and portions other than the exposed face 3*a* may be connected to each other. In each conductor 3 in the present embodiment, not only the exposed face 3*a* but also the whole in a thickness direction of the conductor 3 is divided by the element body 2. The thickness direction of the conductor 3 is the direction D2 for the conductor portion 31 and the direction D1 for the conductor portion 32. Thus, the conductor portion 31 is completely divided by the element body 2 into a portion having the divided region R1 and a portion having the divided region R2. The conductor portion 32 is completely divided by the element body 2 into a portion having the divided region R3 and a portion having the divided region R4.

Each conductor 3 is formed by laminating a plurality of conductor layers 13 in the direction D3. That is, the lamination direction of the conductor layers 13 is the direction D3. In the actual conductor 3, the conductor layers 13 other than the portion divided by the element body 2 are integrated in such a way that no boundaries between the layers can be visually recognized.

Each conductor 3 may be provided with a plating layer (not shown) containing, for example, Ni, Sn, Au, or the like by electrolytic plating or electroless plating. The plating layer may have, for example, a Ni plating film and an Au plating film. The Ni plating film contains Ni and covers the conductor 3. The Au plating film contains Au and covers the Ni plating film.

The coil conductors 5*c* to 5*f* shown in FIG. 1 are connected to each other to form a coil 10 in the element body 2. The coil axis of the coil 10 is provided along the direction D3. The coil conductors 5*c* to 5*f* are disposed in such a way as to at least partially overlap each other when viewed from the direction D3. The coil conductors 5*c* to 5*f* are disposed apart from the end faces 2*a* and 2*b* and the side faces 2*c*, 2*d*, 2*e*, and 2*f*.

The coil conductors 5*c* to 5*f* are constituted by a group of coil conductor layer 15*c*, 15*d*, 15*e*, and 15*f*. The coil conductors 5*c* to 5*f* may be constituted by laminating a plurality of groups of coil conductor layers 15*c*, 15*d*, 15*e*, and 15*f* in the direction D3. In this case, the groups of the coil conductor layers 15*c* to 15*f* are disposed in such a way as to entirely overlap each other when viewed from the direction D3. In this manner, by laminating the groups of coil conductor layers 15*c* to 15*f*, it is possible to increase the aspect ratio of the coil conductors 5*c* to 5*f* and to improve the Q-value of the coil 10.

The connecting conductor 6 extends in the direction D1. The connecting conductor 6 is connected to the coil conductor 5*c* and another conductor portion 32. The connecting conductor 7 extends in the direction D1. The connecting conductor 7 is connected to the coil conductor 5*f* and the one conductor portion 32. The connecting conductors 6 and 7 are constituted by a group of connecting conductor layers 16 and 17. The connecting conductors 6 and 7 may be constituted by laminating a plurality of groups of connecting conductor layers 16 and 17 in the direction D3. In this case, the groups of the connecting conductor layers 16 and 17 are disposed in such a way as to entirely overlap each other when viewed from the direction D3.

The conductor layers 13, the coil conductor layers 15*c*, 15*d*, 15*e*, and 15*f*, and the connecting conductor layers 16 and 17 includes a conductive material (for example, Ag or Pd). Each layer may include the same material or different materials.

The laminated coil component 1 has layers La, Lb, Lc, Ld, Le, and Lf. For example, the laminated coil component 1 is constituted by laminating, from the side face 2*f* side, one layer La, two layers Lb, one layer Lc, one layer Ld, one layer Le, one layer Lf, two layers Lb, and one layer La, in this order.

The layer La is constituted by the element-body layer 12*a*.

The layer Lb is constituted by combining the element-body layer 12*b* and a pair of conductor layers 13 with each other. The element-body layer 12*b* is provided with a defect portion Rb. The defect portion Rb has shapes corresponding to the respective shapes of the pair of conductor layers 13. The pair of conductor layers 13 is fitted into the defect portion Rb. The element-body layer 12*b* and the pair of conductor layers 13 have mutually complementary relationship as a whole.

The layer Lc is constituted by combining the element-body layer 12*c*, a pair of conductor layers 13, the coil conductor layer 15*c*, and the connecting conductor layer 16 with each other. The element-body layer 12*c* is provided with a defect portion Re. The defect portion Re has shapes corresponding to the respective shapes of the pair of conductor layers 13, the coil conductor layer 15*e*, and the connecting conductor layer 16. The pair of the conductor layers 13, the coil conductor layer 15*c*, and the connecting conductor layer 16 are fitted into the defect portion Rc. The element-body layer 12*c*, the pair of conductor layers 13, the coil conductor layer 15*c*, and the connecting conductor layer 16 have mutually complementary relationship as a whole.

The layer Ld is constituted by combining the element-body layer 12*d*, and the coil conductor layer 15*d* with each other. The element-body layer 12*d* is provided with a defect portion Rd. The defect portion Rd has shape corresponding to the shape of the coil conductor layer 15*d*. The coil conductor layer 15*d* is fitted into the defect portion Rd. The element-body layer 12*d*, and the coil conductor layer 15*d* have mutually complementary relationship as a whole.

The layer Le is constituted by combining the element-body layer 12*e*, and the coil conductor layer 15*e* with each other. The element-body layer 12*e* is provided with a defect portion Re. The defect portion Re has shape corresponding to the shapes of the coil conductor layer 15*e*. The coil conductor layer 15*e* is fitted into the defect portion Re. The element-body layer 12*e*, and the coil conductor layer 15*e* have mutually complementary relationship as a whole.

The layer Lf is constituted by combining the element-body layer 12*f*, a pair of conductor layers 13, the coil conductor layer 15*f*, and the connecting conductor layer 17 with each other. The element-body layer 12*f* is provided with a defect portion Rf. The defect portion Rf has shapes corresponding to the respective shapes of the pair of conductor layers 13, the coil conductor layer 15*f*, and the connecting conductor layer 17. The pair of the conductor layers 13, the coil conductor layer 15*f*, and the connecting conductor layer 17 are fitted into the defect portion Rf. The element-body layer 12*f*, the pair of conductor layers 13, the coil conductor layer 15*f*, and the connecting conductor layer 17 have mutually complementary relationship as a whole.

The widths of the defect portions Rb, Re, Rd, Re, and Rf (hereinafter, the width of the defect portion) are basically set in such a way as to be wider than the those of the conductor layers 13, the coil conductor layers 15*c*, 15*d*, 15*e*, and 15*f*, and the connecting conductor layers 16 and 17 (hereinafter, the width of the conductor portion). The width of the defect portion may be intentionally set in such a way as to be narrower than the width of the conductor portion in order for the element-body layers 12*b*, 12*c*, 12*d*, 12*e*, and 12*f* to adhere to the conductor layers 13, the coil conductor layers 15*c*, 15*d*, 15*e*, and 15*f*, and the connecting conductor layers 16 and 17 more firmly. The value obtained by subtracting the width of the conductor portion from the width of the defect portion is preferably, for example, −3 μm or more and 10 μm or less, and more preferably 0 μm or more and 10 μm or less.

An example of a method for manufacturing the laminated coil component 1 according to the embodiment is described.

First, an element-body paste containing the constituent material of the element-body layers 12*a* to 12*f* and a photosensitive material is applied on a substrate (for example, a PET film). An element-body forming layer is thereby formed. The photosensitive material contained in the element-body paste may be either a negative type or a positive type, and a known photosensitive material can be used. Then, the element-body forming layer is exposed and developed by, for example, a photolithography method using a Cr mask. An element-body pattern from which a shape corresponding to the shape of a conductor forming layer to be described later is removed is thereby formed on the substrate. The element-body pattern is a layer to be each of the element-body layers 12*b*, 12*c*, 12*d*, 12*e*, and 12*f* after heat treatment. That is, the element-body pattern provided with defect portions to be the defect portions Rb, Rc, Rd, Re, and Rf is formed. Note that, the "photolithography method" in the present embodiment is only required to be a method for forming a desired pattern by exposing and developing a layer to be patterned containing a photosensitive material, and is not limited to the type of mask or the like.

On the other hand, a conductor paste containing the constituent materials of the above conductor layer 13, the coil conductor layers 15*c*, 15*d*, 15*e*, and 15*f*, and the connecting conductor layers 16 and 17, and a photosensitive material is applied on a substrate (for example, a PET film). A conductor forming layer is thereby formed. The photosensitive material contained in the conductor paste may be either a negative type or a positive type, and a known photosensitive material can be used. Then, the conductor forming layer is exposed and developed by, for example, a photolithography method using a Cr mask. A conductor pattern is thereby formed on the substrate. The conductor pattern is a layer to be each of the conductor layer 13, the coil conductor layers 15*c*, 15*d*, 15*e*, and 15*f*, and the connecting conductor layers 16 and 17 after the heat treatment.

Then, the element-body forming layer is transferred from the substrate onto a supporting body. The layer La after the heat treatment is thereby formed.

Then, the conductor pattern and the element-body pattern are repeatedly transferred onto the supporting body. The conductor patterns and the element-body patterns are thereby laminated in the direction D3. Specifically, first, the conductor pattern is transferred from the substrate onto the element-body forming layer. Next, the element-body pattern is transferred from the substrate onto the element-body forming layer. The conductor pattern is combined with the defect portion of the element-body pattern, and the element-body pattern and the conductor pattern are in the same layer on the element-body forming layer. The step of transferring the conductor pattern and element-body pattern is further repeated. The conductor pattern and the element-body pattern are thereby laminated in a state of being combined with each other. The layers to be the layers Lb, Lc, Ld, Le, and Lf after the heat treatment are thereby laminated.

Then, the element-body forming layer is transferred from the substrate onto the layers laminated in the steps of transferring the conductor pattern and the element-body pattern. The layer La after the heat treatment is thereby laminated.

As described above, a laminate constituting the laminated coil component 1 is formed on the supporting body after the heat treatment. Then, the obtained laminate is cut into a predetermined size. Thereafter, the cut laminate is subjected to debinding treatment, and then subjected to the heat treatment. The temperature of the heat treatment is, for example, about 850 to 900° C. The laminated coil component 1 is thereby obtained. As necessary, the conductor 3 may be provided with a plating layer by electrolytic plating or electroless plating after the heat treatment.

As described above, in the laminated coil component 1, the exposed face 3*a* of each conductor 3 is divided in the direction D3 by the element body 2. Thus, it is possible to relax the stress caused by the difference between the thermal shrinkage percentage of the constituent material of the conductor 3 and the thermal shrinkage percentage of the constituent material of the element body 2 particularly on the surface of the element body 2. That is, the stress of the exposed face 3*a* pulling the surface of the element body 2 due to the thermal shrinkage of the constituent material of the conductor 3 is dispersed in the respective divided regions R1 to R4. Accordingly, it is possible to suppress occurrence of cracks on the surface of the element body 2. Since the exposed face 3*a* of each conductor 3 is divided by the element body 2, the contact area between the conductor 3 and the element body 2 is increased, and the fixing strength between the conductor 3 and the element body 2 is improved.

In the laminated coil component 1, the length L1 of each of the divided regions R1 and R2 in the direction D3 is longer than the distance L2 with which the divided regions R1 and R2 are separated from each other and longer than the distance L3 with which the exposed face 31*a* and the side face 2*e* or 2*f* are separated from each other. The length L1 of each of the divided regions R3 and R4 in the direction D3 is longer than the distance L2 with which the divided regions R3 and R4 are separated from each other and longer than the distance L3 with which the exposed face 32*a* and the side face 2*e* or 2*f* are separated from each other. Accordingly, the area of the exposed face 3*a* is easily kept wider as compared with the case in which, for example, the length L1 is shorter than the distances L2 and L3. As a result, it is possible to suppress reduction in the mounting strength when the laminated coil component 1 is mounted on an electronic device by the conductor 3.

The exposed face 3*a* includes the exposed face 31*a* including the divided regions R1 and R2, and the exposed face 32*a* including the divided regions R3 and R4. Thus, it is possible to suppress occurrence of cracks on the side face 2*e* on which the exposed face 31*a* is exposed and on each of the end faces 2*a* and 2*b* on which the exposed face 32*a* is exposed.

The divided regions R1 and R2 are not connected to each other, and the exposed face 31*a* is completely divided. The divided regions R3 and R4 are not connected to each other, and the exposed face 32*a* is completely divided. Thus, it is possible to further suppress occurrence of cracks on the side face 2*c* and the end faces 2*a* and 2*b*.

The exposed faces 31*a* and 32*a* are divided in the direction D3 which is the opposing direction of the side faces 2*e* and 2*f*. Thus, the amount of shrinkage of each of the divided regions R1 to R4 in the direction D3 is smaller than the amount of shrinkage of the undivided exposed faces 31*a* and 32*a* as a whole. Accordingly, it is possible to further suppress occurrence of cracks extending from the ends at the side faces 2*e* and 2*f* sides of the exposed faces 31*a* and 32*a* toward the side faces 2*e* and 2*f*.

Second Embodiment

Figure 5:
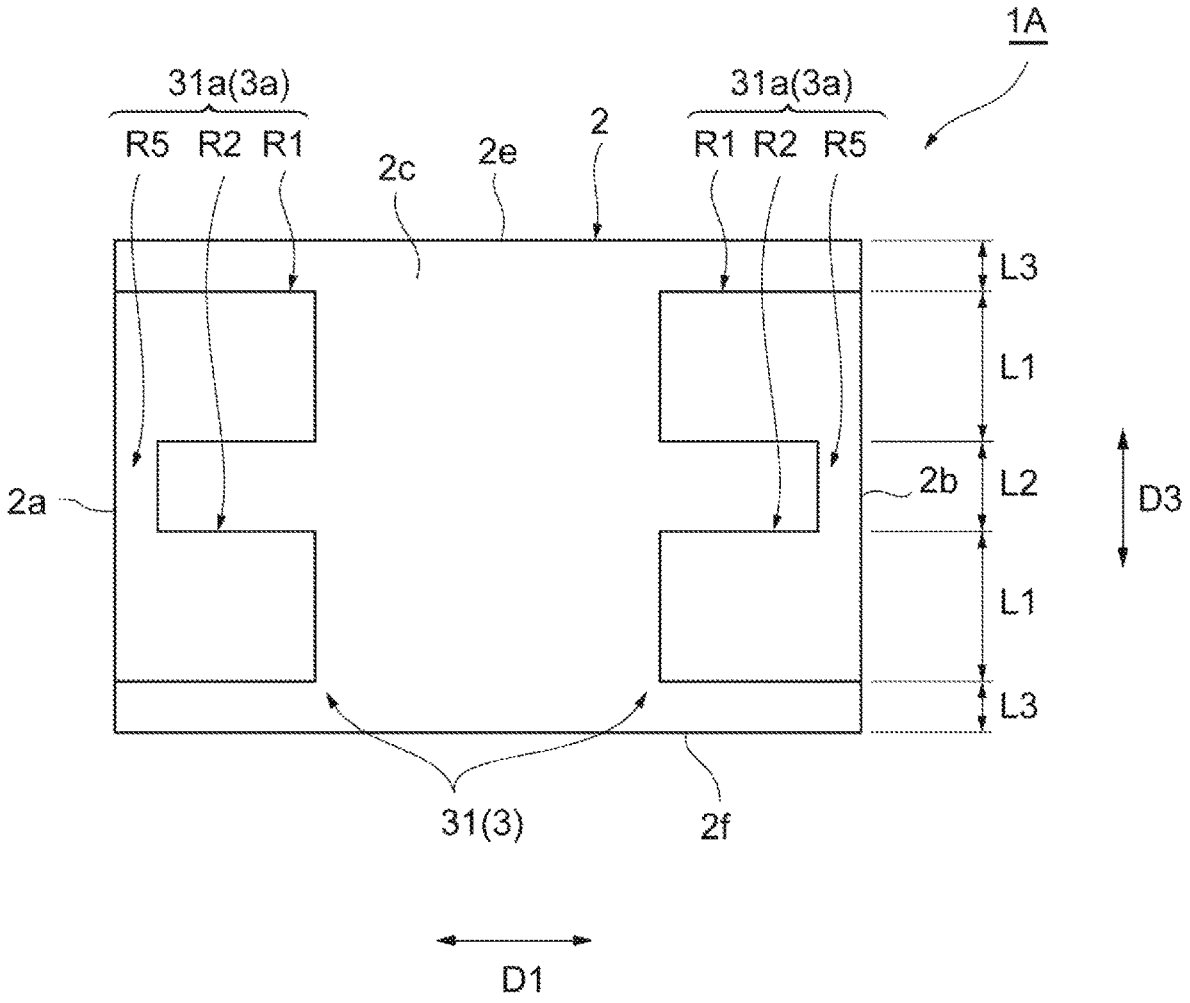
FIG. 5 is a plan view of a laminated coil component according to a second embodiment when viewed from a mounting surface side.
Figure 6:
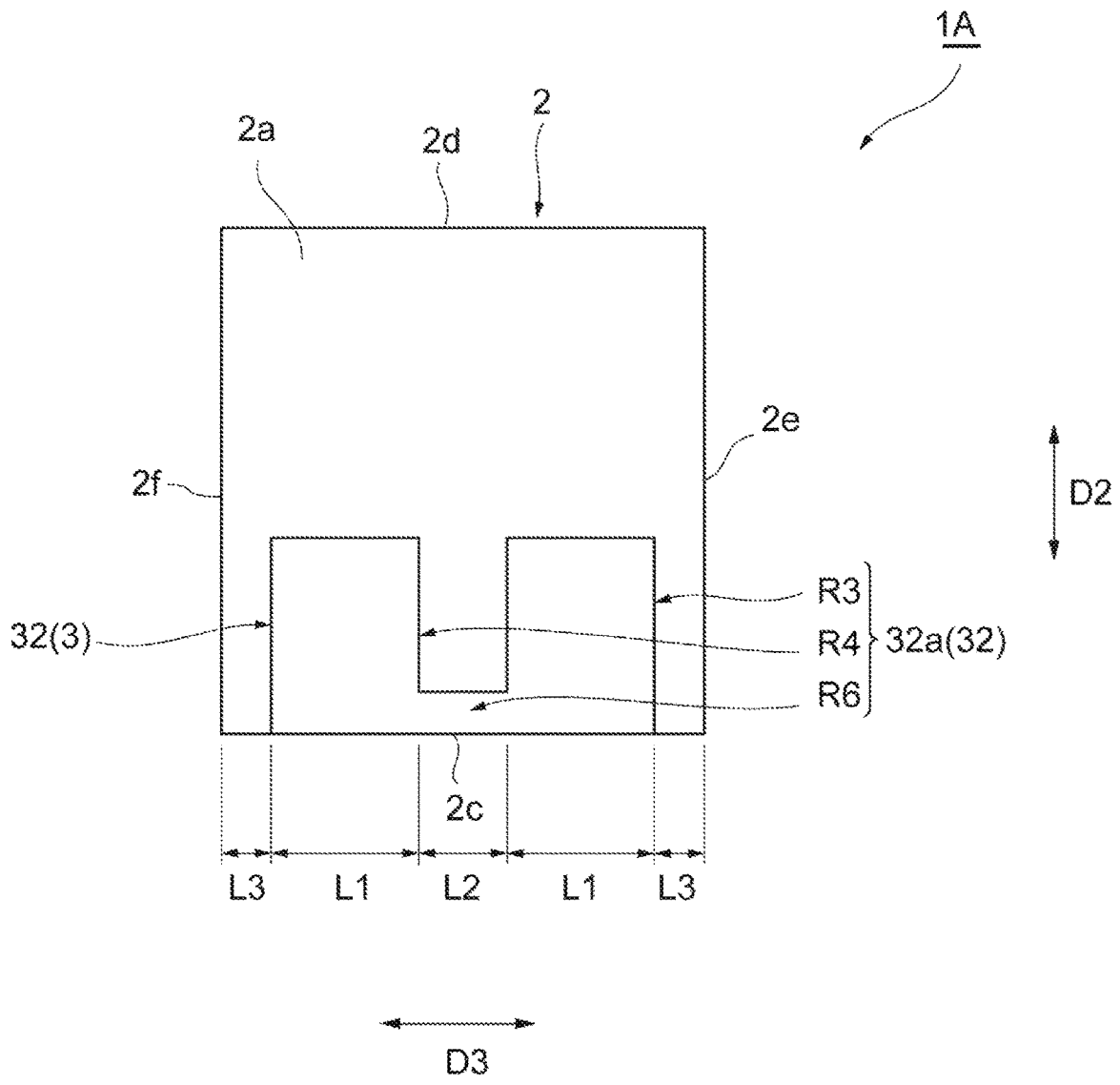
FIG. 6 is a plan view of the laminated coil component in FIG. 5 when viewed from an end face side.
Figure 7:
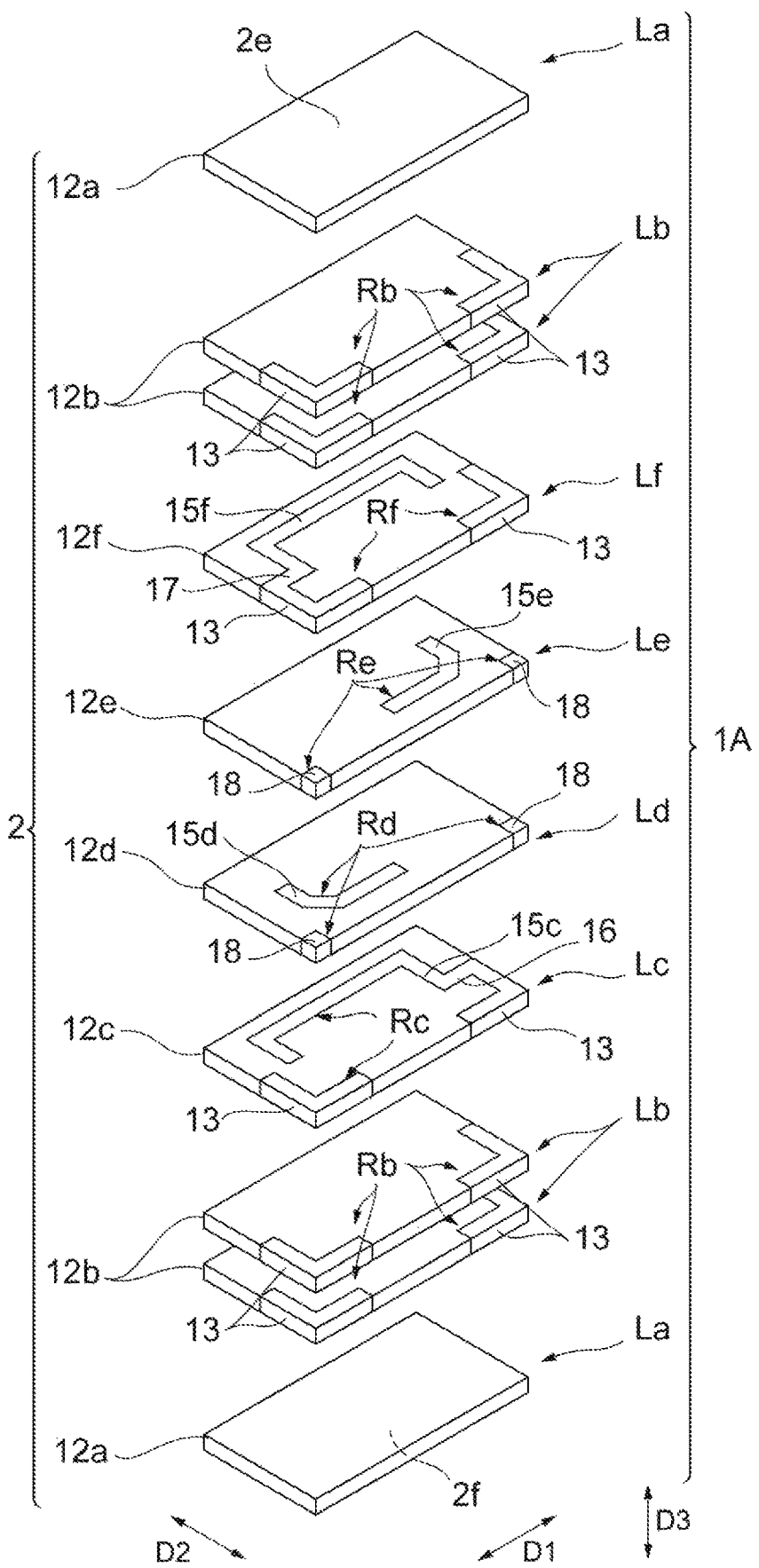
FIG. 7 is an exploded perspective view of the laminated coil component in FIG. 5.

With reference to FIGS. 5 to 7, a laminated coil component according to a second embodiment will be described. FIG. 5 is a plan view of the laminated coil component according to the second embodiment when viewed from a mounting surface side. FIG. 6 is a plan view of the laminated coil component in FIG. 5 when viewed from an end face 2*a* side. FIG. 7 is an exploded perspective view of the laminated coil component in FIG. 5. As shown in FIGS. 5 to 7, a laminated coil component 1A according to the second embodiment differs from the laminated coil component 1 according to the first embodiment (see FIG. 1) mainly in that exposed faces 31*a* and 32*a* of each conductor 3 are not completely divided. The laminated coil component 1A will be described below focusing on differences from the laminated coil component 1.

In the laminated coil component 1A, the exposed face 31*a* includes divided regions R1 and R2 and a connection region R5. The connection region R5 connects the divided region R1 to the divided region R2. That is, the exposed face 31*a* is not completely divided. The exposed face 32*a* includes divided regions R3 and R4 and a connection region R6. The connection region R6 connects the divided region R3 to the divided region R4. That is, the exposed face 32*a* is not completely divided.

In the laminated coil component 1A, each conductor 3 is formed by laminating a plurality of conductor layers 18 in the direction D3 in addition to a plurality of conductor layers 13. Each conductor layer 18 has a pair of exposed faces. One exposed face is exposed on a side face 2*c* to be the connection region R5. Another exposed face is exposed to an end face 2*a* or 2*b* to be the connection region R6. The lamination direction of the conductor layers 13 and the conductor layers 18 is the direction D3. The connection regions R5 and R6 have the same shape. The connection regions R5 and R6 are connected to each other at the ridge portion of the side face 2*c*.

In the laminated coil component 1 (see FIG. 4), the layer Ld is constituted by combining the element-body layer 12*d*, and the coil conductor layer 15*d* with each other. In contrast, in the laminated coil component 1A, the layer Ld is constituted by combining the element-body layer 12*d*, the coil conductor layer 15*d*, and the conductor layer 18 with each other. The defect portion Rd has shapes corresponding to the respective shapes of the coil conductor layer 15*d*, and the conductor layer 18. The coil conductor layer 15*d*, and the conductor layer 18 are fitted into the defect portion Rd.

In the laminated coil component 1 (see FIG. 4), the layer Le is constituted by combining the element-body layer 12*e*, and the coil conductor layer 15*e* with each other. In contrast, in the laminated coil component 1A, the layer Le is constituted by combining the element-body layer 12*e*, the coil conductor layer 15*e*, and the conductor layer 18 with each other. The defect portion Re has shapes corresponding to the respective shapes of the coil conductor layer 15*e*, and the conductor layer 18. The coil conductor layer 15*e*, and the conductor layer 18 are fitted into the defect portion Re.

Also in the laminated coil component 1A, it is possible to obtain effects similar to those of the laminated coil component 1 (see FIG. 1). That is, since the exposed face 3*a* is divided, it is possible to suppress occurrence of cracks on the surface of the element body 2. Since the length L1 is longer than the distances L2 and L3, the area of the exposed face 3*a* is easily kept wide, and it is possible to suppress reduction in the mounting strength. Since both the exposed faces 31*a* and 32*a* are divided, it is possible to suppress occurrence of cracks on the side face 2*c* and the end faces 2*a* and 2*b*. Since the exposed faces 31*a* and 32*a* are divided in the direction D3, it is possible to further suppress occurrence of cracks extending from the ends at the side faces 2*e* and 2*f* sides of the exposed faces 31*a* and 32*a* toward the side faces 2*e* and 2*f*.

Since the exposed face 3*a* includes the connection region R5 or R6, the laminated coil component 1A has a larger area of the exposed face 3*a* than that of the laminated coil component 1. Thus, it is possible to more reliably suppress reduction in the mounting strength.

Third Embodiment

Figure 8:
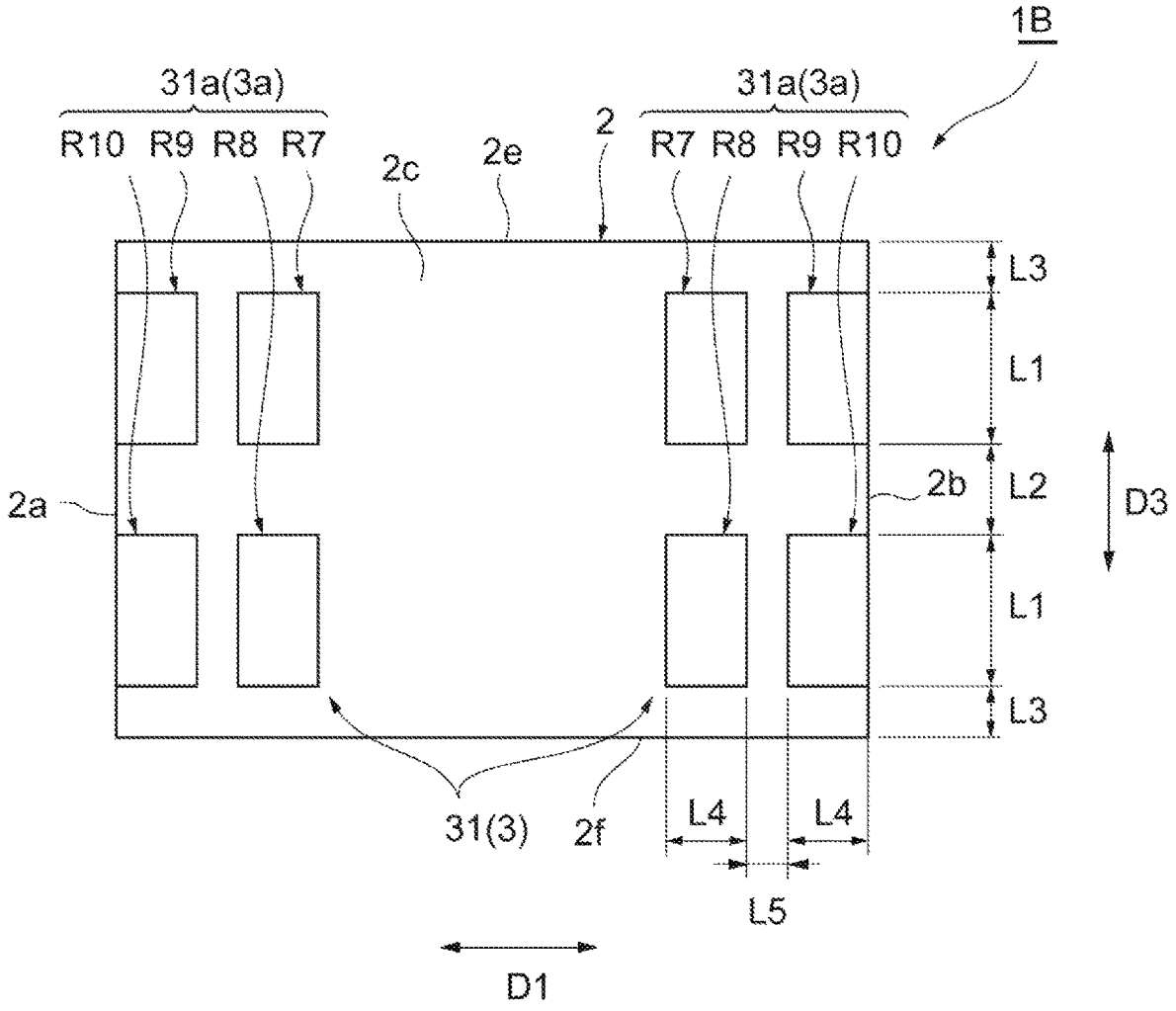
FIG. 8 is a plan view of a laminated coil component according to a third embodiment when viewed from a mounting surface side.
Figure 9:
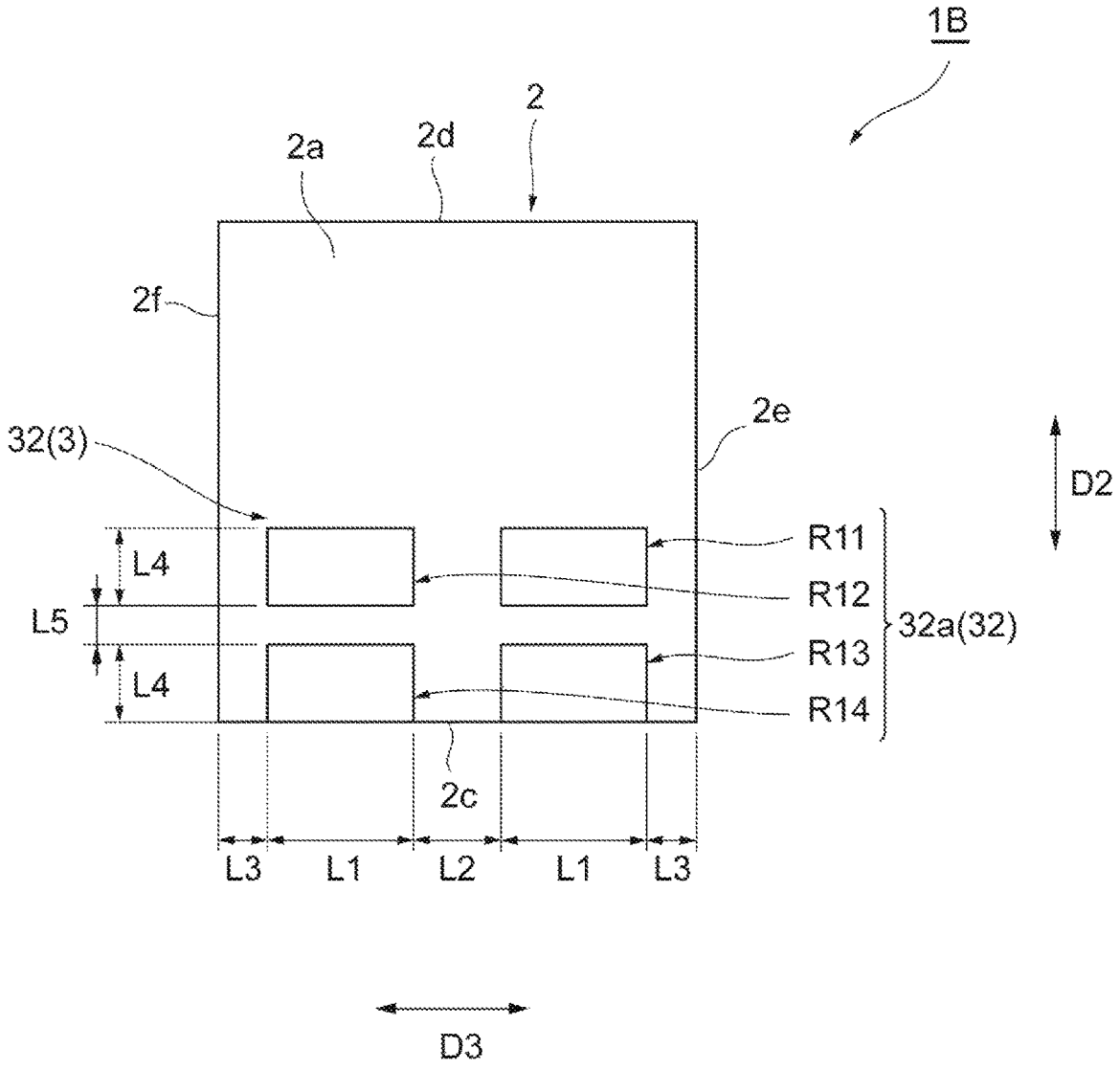
FIG. 9 is a plan view of the laminated coil component in FIG. 8 when viewed from an end face side.
Figure 10:
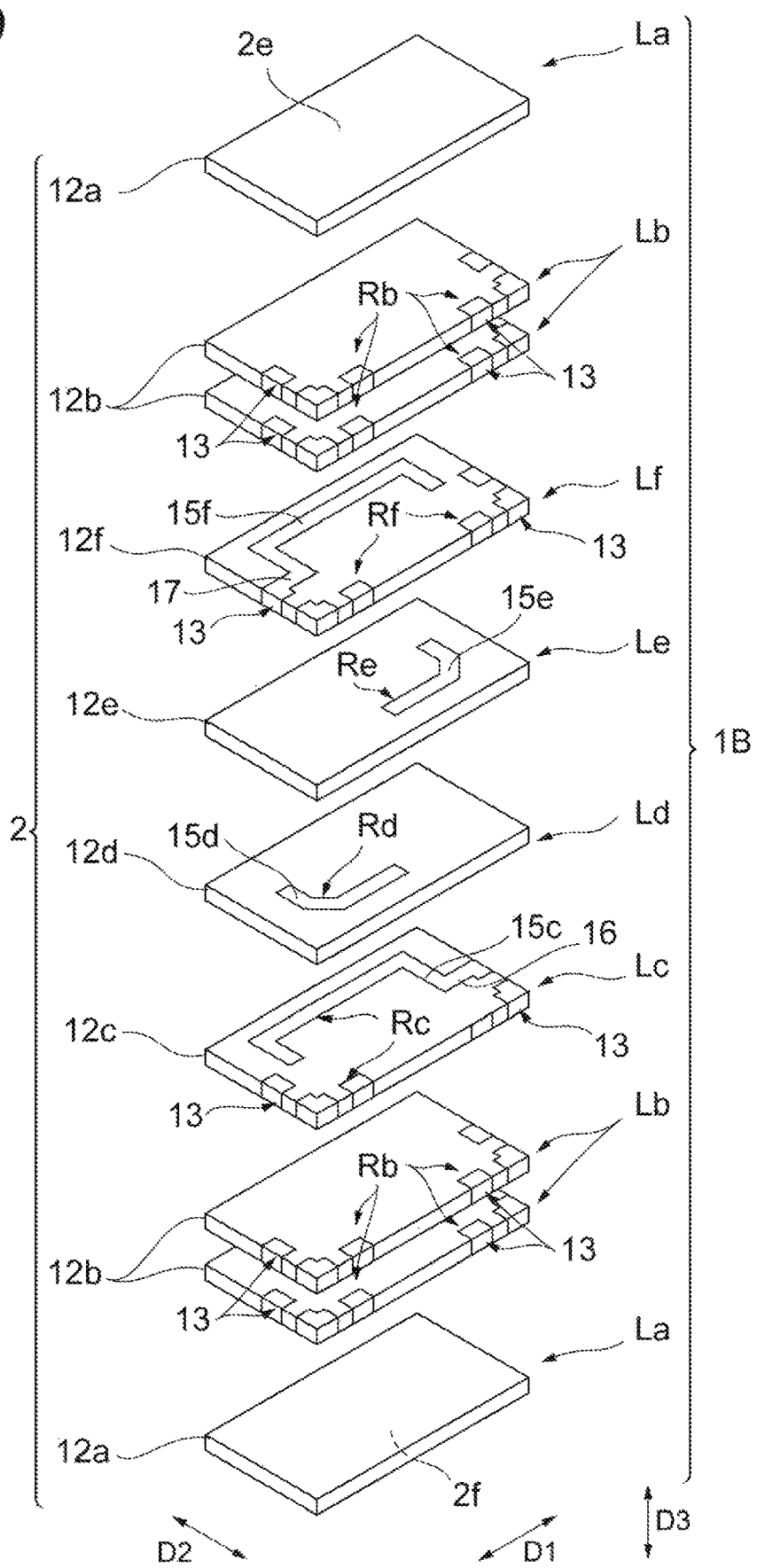
FIG. 10 is an exploded perspective view of the laminated coil component in FIG. 8.

With reference to FIGS. 8 to 10, a laminated coil component according to a third embodiment will be described. FIG. 8 is a plan view of the laminated coil component according to the third embodiment when viewed from a mounting surface side. FIG. 9 is a plan view of the laminated coil component in FIG. 8 when viewed from an end face 2*a* side. FIG. 10 is an exploded perspective view of the laminated coil component in FIG. 8. As shown in FIGS. 8 to 10, a laminated coil component 1B according to the third embodiment differs from the laminated coil component 1 according to the first embodiment (see FIG. 1) mainly in that an exposed face 31*a* is also divided in the direction D1 in addition to the direction D3 and that an exposed face 32*a* is also divided also in the direction D2 in addition to the direction D3. The laminated coil component 1B will be described below focusing on differences from the laminated coil component 1.

In the laminated coil component 1B, the exposed face 31*a* is divided in the direction D3 and the direction D1 by an element body 2. Accordingly, the exposed face 31*a* includes a plurality of divided regions R7, R8, R9, and R10 that are divided in a grid or a matrix. The exposed face 32*a* is divided in the direction D3 and the direction D2 by the element body 2. Accordingly, the exposed face 32*a* includes a plurality of divided regions R11, R12, R13, and R14 divided in a grid or a matrix. The divided regions R7 to R14 have the same shape. The divided regions R7 to R14 each have a rectangular shape.

The divided regions R7 and R8 are divided in the direction D3 and separated from each other in the direction D3. The divided regions R9 and R10 are divided in the direction D3 and separated from each other in the direction D3. The divided regions R7 and R9 are divided in the direction D1 and separated from each other in the direction D1. The divided regions R8 and R10 are divided in the direction D1 and separated from each other in the direction D1. The divided regions R7 to R10 are not connected to each other, and the exposed face 31*a* is completely divided.

The divided regions R11 and R12 are divided in the direction D3 and separated from each other in the direction D3. The divided regions R13 and R14 are divided in the direction D3 and separated from each other in the direction D3. The divided regions R11 and R13 are divided in the direction D2 and separated from each other in the direction D2. The divided regions R12 and R14 are divided in the direction D2 and separated from each other in the direction D2. The divided regions R11 to R14 are not connected to each other, and the exposed face 32*a* is completely divided.

The divided regions R7, R9, R11, and R13 are disposed by the side of the side face 2*e* (closer to the side face 2*e* than the side face 20. The divided regions R9 and R13 are connected to each other at the ridge portion of the side face 2*c*. The divided regions R8, R10, R12, and R14 are disposed by the side of the side face 2*f* (closer to the side face 2*f* than the side face 2*e*). The divided regions R10 and R14 are connected to each other at the ridge portion of the side face 2*c*.

The length L1 of each of the divided regions R7 to R10 in the direction D3 is longer than the distance L2 with which the divided regions R7 and R8 are separated from each other, longer than the distance L2 with which the divided regions R9 and R10 are separated from each other, and longer than the distance L3 with which the exposed face 31*a* and the side face 2*e* or 2*f* are separated from each other. The length L4 of each of the divided regions R7 to R10 in the direction D1 is longer than the distance L5 with which the divided regions R7 and R9 are separated from each other, longer than the distance L5 with which the divided regions R8 and R10 are separated from each other, and longer than the distance L3 with which the exposed face 31*a* and the side face 2*e* or 2*f* are separated from each other.

The length L1 of each of the divided regions R11 to R14 in the direction D3 is longer than the distance L2 with which the divided regions R11 and R12 are separated from each other, longer than the distance L2 with which the divided regions R13 and R14 are separated from each other, and longer than the distance L3 with which the exposed face 32*a* and the side face 2*e* or 2*f* are separated from each other. The length L4 of each of the divided regions R11 to R14 in the direction D2 is longer than the distance L5 with which the divided regions R11 and R13 are separated from each other, longer than the distance L5 with which the divided regions R12 and R14 are separated from each other, and longer than the distance L3 with which the exposed face 32*a* and the side face 2*e* or 2*f* are separated from each other.

Also in the laminated coil component 1B, it is possible to obtain effects similar to those of the laminated coil component 1 (see FIG. 1). That is, since the exposed face 3*a* is divided, it is possible to suppress occurrence of cracks on the surface of the element body 2. Since the length L1 is longer than the distances L2 and L3 and the length L4 is longer than the distances L5 and L3, the area of the exposed face 3*a* is easily kept wide, and it is possible to suppress reduction in the mounting strength. Since both the exposed faces 31*a* and 32*a* are divided, it is possible to suppress occurrence of cracks on the side face 2*c* and the end faces 2*a* and 2*b*. Since the exposed faces 31*a* and 32*a* are divided in the direction D3, it is possible to further suppress occurrence of cracks extending from the ends at the side faces 2*e* and 2*f* sides of the exposed faces 31*a* and 32*a* toward the side faces 2*e* and 2*f*.

In the laminated coil component 1B, the exposed face 31*a* is also divided in the direction D1 in addition to the direction D3, and the exposed face 32*a* is also divided in the direction D2 in addition to the direction D3. Thus, the area of the divided regions R7 to R14 is smaller than that of the divided regions R1 to R4 (see FIGS. 2 and 3). Thus, the stress caused by the difference between the thermal shrinkage percentage of the constituent material of the conductor 3 and the thermal shrinkage percentage of the constituent material of the element body 2 is further relaxed on the surface of the element body 2. As a result, it is possible to further suppress occurrence of cracks on the surface of the element body 2.

Fourth Embodiment

Figure 11:
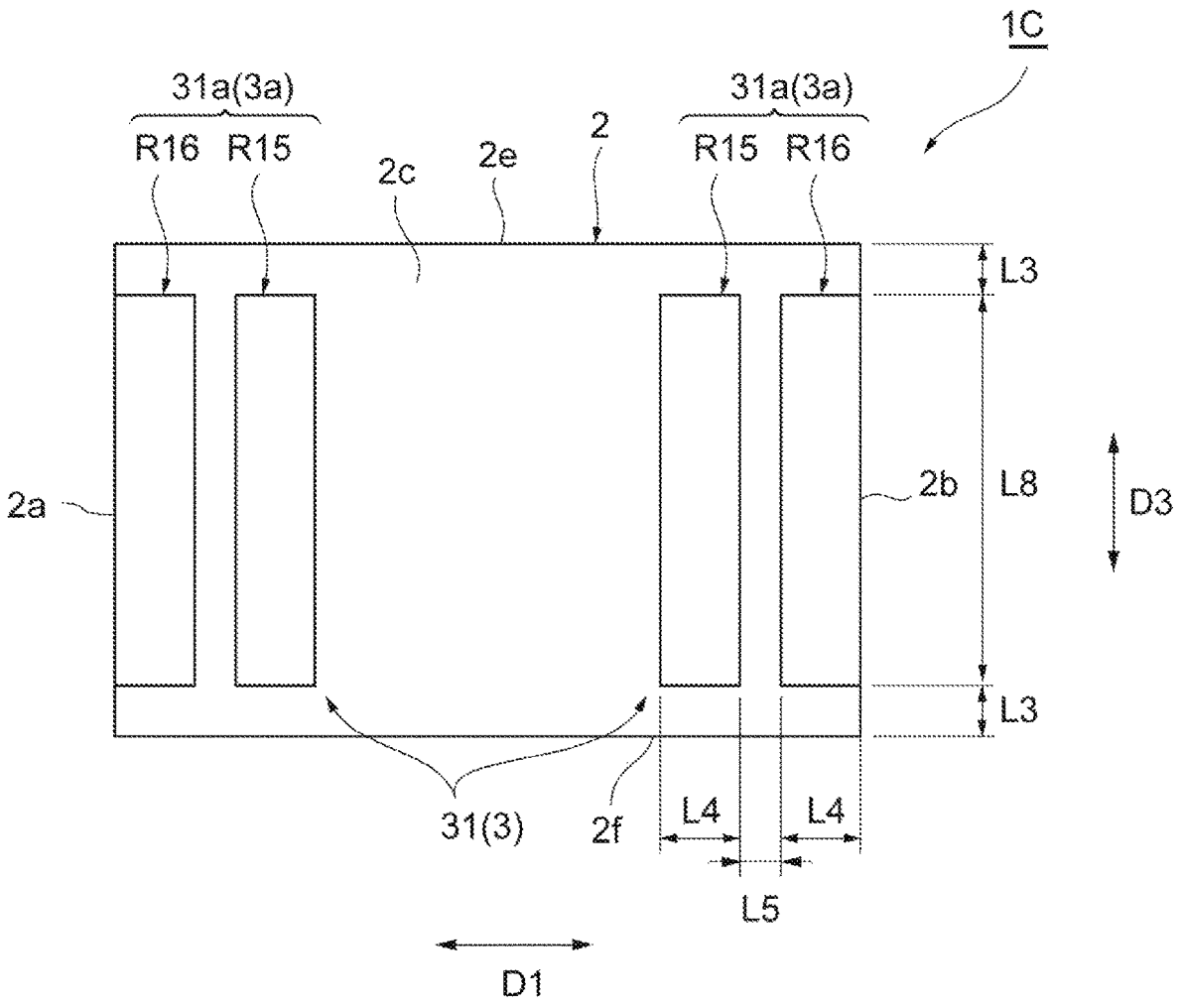
FIG. 11 is a plan view of a laminated coil component according to a fourth embodiment when viewed from a mounting surface side.
Figure 12:
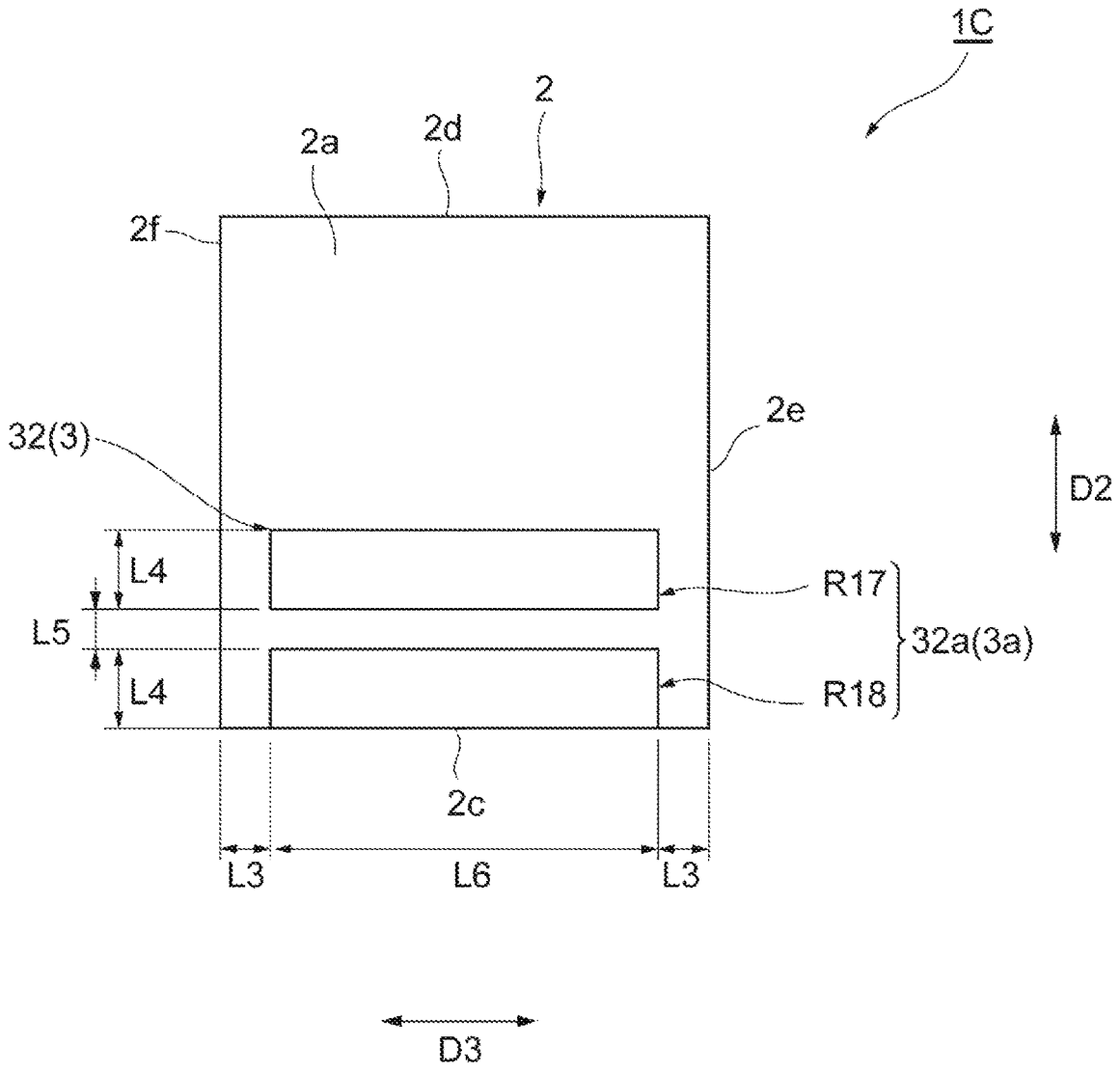
FIG. 12 is a plan view of the laminated coil component in FIG. 11 when viewed from an end face side.
Figure 13:
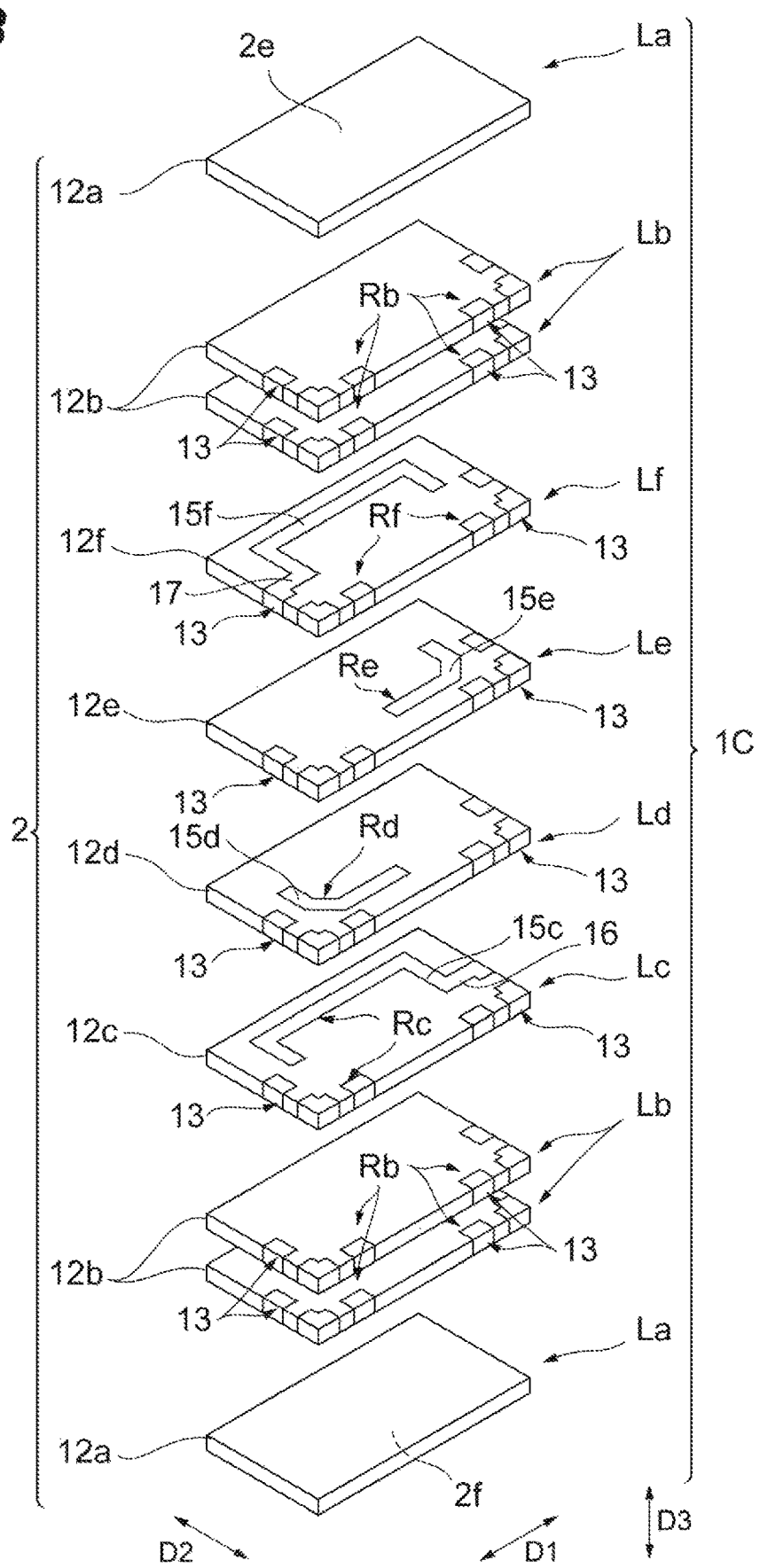
FIG. 13 is an exploded perspective view of the laminated coil component in FIG. 11.

With reference to FIGS. 11 to 13, a laminated coil component according to a fourth embodiment will be described. FIG. 11 is a plan view of the laminated coil component according to the fourth embodiment when viewed from a mounting surface side. FIG. 12 is a plan view of the laminated coil component in FIG. 11 when viewed from an end face 2*a* side. FIG. 12 is an exploded perspective view of the laminated coil component in FIG. 11. As shown in FIGS. 11 to 13, a laminated coil component 1C according to the fourth embodiment differs from the laminated coil component 1B according to the third embodiment (See FIGS. 8 and 9) in that exposed faces 31*a* and 32*a* are not divided in the direction D3. The laminated coil component 1C will be described below focusing on differences from the laminated coil components 1 and 1B.

In the laminated coil component 1C, the exposed face 31*a* includes a plurality of divided regions R15 and R16 divided in the direction D1 by an element body 2. The exposed face 32*a* includes a plurality of divided regions R17 and R18 divided in the direction D2 by the element body 2. The divided regions R15 to R18 have the same shape. The divided regions R15 to R18 each have a rectangular shape.

The divided regions R15 and R16 are divided in the direction D1 and separated from each other in the direction D1. The divided regions R17 and R18 are divided in the direction D2 and separated from each other in the direction D2. The divided regions R15 and R16 are not connected to each other, and the exposed face 31*a* is completely divided. The divided regions R17 and R18 are not connected to each other, and the exposed face 32*a* is completely divided.

The divided regions R16 and R18 are connected to each other at the ridge portion of a side face 2*c*.

The length L4 of each of the divided regions R15 and R16 in the direction D1 is longer than the distance L5 with which the divided regions R15 and R16 are separated from each other and longer than the distance L3 with which the exposed face 31*a* and the side face 2*e* or 2*f* are separated from each other. The length L4 of each of the divided regions R17 and R18 in the direction D2 is longer than the distance L5 with which the divided regions R17 and R18 are separated from each other and longer than the distance L3 with which the exposed face 32*a* and the side face 2*e* or 2*f* are separated from each other. The length L6 of each of the divided regions R15 to R18 in the direction D3 is equivalent to the sum of twice the length L1 (see FIGS. 8 and 9) and the distance L2 (see FIGS. 8 and 9).

In the laminated coil component 1 (see FIG. 4), the layer Ld is constituted by combining the element-body layer 12*d*, and the coil conductor layer 15*d* with each other. In contrast, in the laminated coil component 1C, the layer Ld is constituted by combining the element-body layer 12*d*, the coil conductor layer 15*d*, and the conductor layer 13 with each other. The defect portion Rd has shapes corresponding to the respective shapes of the coil conductor layer 15*d*, and the conductor layer 13. The coil conductor layer 15*d*, and the conductor layer 13 are fitted into the defect portion Rd.

In the laminated coil component 1 (see FIG. 4), the layer Le is constituted by combining the element-body layer 12*e*, and the coil conductor layer 15*e* with each other. In contrast, in the laminated coil component 1C, the layer Le is constituted by combining the element-body layer 12*e*, the coil conductor layer 15*e*, and the conductor layer 13 with each other. The defect portion Re has shapes corresponding to the respective shapes of the coil conductor layer 15*e*, and the conductor layer 13. The coil conductor layer 15*e*, and the conductor layer 13 are fitted into the defect portion Re.

Also in the laminated coil component 1C, it is possible to obtain effects similar to those of the laminated coil component 1 (see FIG. 1). That is, since the exposed face 3*a* is divided, it is possible to suppress occurrence of cracks on the surface of the element body 2. Since the length L4 is longer than the distances L5 and L3, the area of the exposed face 3*a* is easily kept wide, and it is possible to suppress reduction in the mounting strength. Since both the exposed faces 31*a* and 32*a* are divided, it is possible to suppress occurrence of cracks on the side face 2*c* and the end faces 2*a* and 2*b*.

The present invention is not limited to the above embodiments, and various modifications can be made.

In the laminated coil components 1, 1A, 1B, and 1C, for example, the pair of conductors 3 may have different shapes from each other, and at least one of the pair of conductors 3 is only required to have the divided exposed face 3*a*. The exposed faces 31*a* and 32*a* may have different shapes from each other. At least one of the exposed faces 31*a* and 32*a* is only required to be divided. Each divided region may not have the same shape. Each divided region may have a shape other than a rectangular shape. The exposed faces 31*a* and 32*a* may not be connected to each other but may be divided at the ridge portion of the side face 2*c*.

In the laminated coil components 1, 1A, the exposed faces 31*a* and 32*a* are each divided into two divided regions in the direction D3, but may be divided into three or more divided regions. In the laminated coil component 1C, the exposed face 31*a* is divided into two divided regions in the direction D1, but may be divided into three or more divided regions. The exposed face 32*a* is divided into two divided regions in the direction D2, but may be divided into three or more divided regions. In the laminated coil component 1B, the exposed faces 31*a* and 32*a* are each divided in a grid or a matrix, but may be further divided finely. In such a case, it is possible to further suppress occurrence of cracks. In addition, the fixing strength between the conductor 3 and the element body 2 is further improved.

In the embodiments described above, the laminated coil components 1, 1A, and 1B have been described as examples of a laminated electronic component, but the present invention is not limited to these, and can be applied to other laminated electronic components such as laminated ceramic capacitors, laminated varistors, laminated piezoelectric actuators, laminated thermistors, and laminated composite components.

What is claimed is:

1. A laminated electronic component comprising:

an element body having a rectangular parallelepiped shape and formed by laminating a plurality of element-body layers in a laminating direction, the element body having:

a first face;

a second face adjacent to the first face;

a pair of third faces opposed to each other and adjacent to the first face and the second face; and a depression disposed on the first face and the second face;

a conductor disposed on the element body in the depression and having an L shape, the conductor having an exposed portion exposed on the first face and the second face, the exposed portion including a plurality of divided regions divided by the element body; and a coil including a plurality of coil conductors, wherein a length of each of the divided regions in a dividing direction is longer than a distance with which the plurality of divided regions is separated from each other and longer than a distance with which the exposed portion and the pair of third faces are separated from each other, and a thickness of each of the coil conductors in the laminating direction is less than the distance with which the plurality of divided regions is separated from each other.

2. The laminated electronic component according to claim 1, wherein the exposed face has a first exposed face exposed on the first face and a second exposed face exposed on the second face, and the first exposed face and the second exposed face each include the plurality of divided regions.

3. The laminated electronic component according to claim 1, wherein the exposed face is completely divided.

4. The laminated electronic component according to claim 1, wherein the exposed face is divided in an opposing direction of the pair of third faces.

5. A laminated electronic component comprising:

an element body having a rectangular parallelepiped shape and formed by laminating a plurality of element-body layers in a laminating direction, the element body having:

a first face;

a second face adjacent to the first face;

a pair of third faces opposed to each other and adjacent to the first face and the second face; and a depression disposed on the first face and the second face;

a conductor disposed on the element body in the depression and having an L shape, the conductor having an exposed portion exposed on the first face and the second face, the exposed portion including a plurality of regions separated from each other in an opposing direction of the pair of third faces; and a coil including a plurality of coil conductors, wherein a length of each of the regions in the opposing direction is longer than a distance with which the plurality of regions is separated from each other in the opposing direction and longer than a distance with which the exposed portion and the pair of third faces are separated from each other in the opposing direction, and a thickness of each of the coil conductors in the laminating direction is less than the distance with which the plurality of regions is separated from each other.

6. A laminated electronic component comprising:

an element body having a rectangular parallelepiped shape and formed by laminating a plurality of element-body layers, the element body having:

a first face;

a second face adjacent to the first face;

a pair of third faces opposed to each other and adjacent to the first face and the second face;

a fourth face opposed to the second face; and a depression disposed on the first face and the second face; and a conductor disposed on the element body in the depression and having a broken L shape, the conductor having an exposed portion exposed on the first face and the second face, the exposed portion including a plurality of regions separated from each other in an orthogonal direction orthogonal to an opposing direction of the pair of third faces, the exposed portion being separated from the fourth face, wherein a length of each of the regions in the orthogonal direction is longer than a distance with which the plurality of regions is separated from each other in the orthogonal direction and longer than a distance with which the exposed portion and the pair of third faces are separated from each other in the opposing direction.

* * * * *